US009533744B2

(12) United States Patent
Leatherman

(10) Patent No.: US 9,533,744 B2
(45) Date of Patent: Jan. 3, 2017

(54) LIFESAVING BEACH BAG FOR WATER RESCUE

(71) Applicant: Stephen Parker Leatherman, Miami, FL (US)

(72) Inventor: Stephen Parker Leatherman, Miami, FL (US)

( * ) Notice: Subject to any disclaimer, the term of this patent is extended or adjusted under 35 U.S.C. 154(b) by 0 days.

(21) Appl. No.: 14/756,129

(22) Filed: Aug. 5, 2015

(65) Prior Publication Data

US 2016/0009346 A1 Jan. 14, 2016

Related U.S. Application Data

(63) Continuation-in-part of application No. 13/507,140, filed on Jun. 7, 2012, now Pat. No. 9,162,737.

(60) Provisional application No. 61/520,815, filed on Jun. 15, 2011.

(51) Int. Cl.

| | |
|---|---|
| ***B63C 9/26*** | (2006.01) |
| ***B63C 9/08*** | (2006.01) |
| ***A45C 3/10*** | (2006.01) |
| ***A45C 3/00*** | (2006.01) |
| ***A45C 9/00*** | (2006.01) |
| ***A45C 13/30*** | (2006.01) |

(52) U.S. Cl.

CPC ..... *B63C 9/26* (2013.01); *A45C 3/001* (2013.01); *A45C 3/10* (2013.01); *A45C 9/00* (2013.01); *A45C 13/30* (2013.01); *B63C 9/08* (2013.01)

(58) Field of Classification Search

CPC ..... B63C 9/00; B63C 9/08; B63C 9/081; B63C 9/26; A45C 3/00; A45C 3/001; A45C 3/10; A45C 13/30; A45C 15/00

USPC ..... 441/75, 80, 81, 84, 88, 89, 96, 125

See application file for complete search history.

(56) References Cited

U.S. PATENT DOCUMENTS

| | | | | |
|---|---|---|---|---|
| 2,542,477 A * | 2/1951 | Cart | A45C 9/00 441/125 |
| 3,676,882 A | 7/1972 | Lindqvist | 9/14 |
| 4,157,134 A | 6/1979 | Stoll | 190/1 |
| 4,560,356 A | 12/1985 | Burr | 441/80 |
| 4,713,033 A * | 12/1987 | Cameron | B63C 9/26 441/84 |
| 4,822,309 A | 4/1989 | Vandenberg | 441/35 |
| 4,836,815 A | 6/1989 | Spurgeon | 441/84 |
| 4,966,279 A | 10/1990 | Pearcy | 206/315.11 |
| 5,230,645 A | 7/1993 | Cheng | 441/123 |
| 5,439,405 A | 8/1995 | Storey et al. | |
| 5,540,178 A | 7/1996 | Damron | 114/362 |

(Continued)

*Primary Examiner* — Lars A Olson
(74) *Attorney, Agent, or Firm* — David A. Burge

(57) ABSTRACT

A lightweight, rugged and easy-to-carry beach bag is well suited to serve a primary function as a tote for containing and transporting items useful during an excursion to a beach or other waterside location—items such as towels, swimwear, swimgear, sunscreen, snacks, drinks, reading material and the like. Should an emergency arise necessitating a rescue of a person in peril of drowning, the bag's contents are jettisoned, enabling a quick collapse of the bag as a chain of hinged flotation elements that form an upstanding sidewall of the bag folds in an orderly manner so the bag forms a compact, substantially flat flotation device well suited to serve a secondary function of keeping afloat the person in peril who forcefully grasps the flotation device so a rescuer can tow the person toward shore by pulling on a lengthy tether securely connected to the flotation device.

25 Claims, 6 Drawing Sheets

(56) References Cited

U.S. PATENT DOCUMENTS

| | | | | |
|---|---|---|---|---|
| 5,653,618 | A | 8/1997 | Cheng | 441/130 |
| 5,868,219 | A | 2/1999 | Sadeck et al. | 182/70 |
| 5,957,583 | A | 9/1999 | DeClements, Jr. et al. | 383/3 |
| 6,000,979 | A | 12/1999 | Stewart | 441/75 |
| 6,257,942 | B1 | 7/2001 | Groover | 441/84 |
| 6,487,725 | B1 | 12/2002 | Jordan | 2/94 |
| 6,568,976 | B2 | 5/2003 | Anderson et al. | 441/80 |
| 6,679,743 | B1 | 1/2004 | Gerber | 441/84 |
| 6,800,007 | B2 * | 10/2004 | Calkin | B63C 9/26 441/80 |
| 9,162,737 | B1 * | 10/2015 | Leatherman | A45C 3/10 |

* cited by examiner

LIFESAVING BEACH BAG FOR WATER RESCUE

CROSS-REFERENCE TO RELATED APPLICATIONS

This non-provisional (utility type) application is a continuation-in-part of a still-pending non-provisional (utility type) application Ser. No. 13/507,140 filed Jun. 7, 2012 by Stephen Parker Leatherman entitled LIFESAVING TOTE BAG that claimed the benefit of a Jun. 15, 2011 filing date of a provisional (utility type) application Ser. No. 61/520,815 entitled LIFESAVING TOTE BAG.

The above-referenced no-provisional (utility type) application Ser. No. 13/507,140 was filed Jun. 7, 2012 while the above-referenced provisional (utility type) application filed Jun. 15, 2011 was still pending.

The disclosures of each of the above-referenced applications are incorporated into the present application by reference.

BACKGROUND

Although beachgoers and the like typically have little if any hesitation to carry a tote bag or other type of simple carry-all device with them during excursions to the beach, a reluctance nonetheless exists to be seen carrying a life preserver, life jacket, life vest or the like on such excursions. Unfortunately, this is true despite the fact that many drownings take place at beaches and along other waterside locations where the availability and quick use of a simple flotation device could save lives.

The term "beach bag" commonly refers to an easy-to-carry tote bag provided with one or more handles, and having a releasably closed interior chamber that is well suited to contain and protectively transport a small collection of items useful during an excursion to a beach or other waterside location. Items typically carried in a beach bag include towels, swimwear, swimgear, sunscreen, snacks, drinks, reading materials and the like. The present invention relates to such a beach bag.

Over the years, variously configured flotation devices have been proposed that are intended to be tossed, thrown, extended or otherwise delivered to a person in peril of drowning so the person can forcefully grasp the flotation device to be kept afloat while being towed toward shore or other location of safety by a rescuer who tugs on an elongate tether securely connected to the flotation device. The present invention relates beach bag having a uniquely configured upstanding sidewall that enables the beach bag to be quickly and easily collapsed by being folded in an orderly manner to form a compact and substantially flat flotation device that is well suited to be forcefully grasped by the person in peril who can then be towed toward shore or other location of safety by a rescuer who pulls on an elongate tether securely connected to the flotation device.

SUMMARY OF THE INVENTION

It has long been desirable to have a rapidly deployable flotation device at hand while one is enjoying an excursion to a beach or other waterside location where a possibility always exists that someone may find themselves in peril of drowning. Even frequent beach visitors can find themselves unexpectedly in need of water rescue—if, for example, they have waded into water that is over their heads, or 2) they are being carried offshore by an unseen current, or 3) they have experienced a life-threatening medical condition.

The present invention takes advantage of the ease and familiarity that beachgoers and others have with beach bags to cause quickly-configurable flotation devices to be inconspicuously brought along during excursions to the beach or other waterside venues—by providing beach bags with substantially unobstructed interior chambers and upstanding sidewalls formed from chains of hingedly connected flotation elements that can quickly fold in an orderly manner to form a compact, substantially flat, easily grasped flotation device once contents of the beach bag are jettisoned.

To insure that an interior chamber of each beach bag that embodies the present invention has the capacity to house and transport a small yet meaningful collection of items that are useful during an excursion to a beach or other waterside location (without causing the bag to become overloaded or too burdensome to carry), the interior chamber preferably has a volume of about a cubic foot, but no greater than about one and a half cubic feet.

To facilitate transporting beach bags embodying the present invention, each bag is preferably provided with one or a pair of handles connected to upper portions of an upstanding sidewall of the bag. In one form, one or two lengthy strap-type handles each have their opposite end regions connected to upper portions of the upstanding sidewall of a bag located on opposite sides of the bag—so the handle or handles loop upwardly as they overlie the the upwardly opening top of the bag. In a more preferred form, two smaller upwardly looping handles each have its opposite end regions connected to an upper portion of the upstanding sidewall of the bag, so that the handles are located on opposite sides of the upwardly opening top of the bag.

Each beach bag that embodies features of the present invention has, in common, two features associated with the interior chamber of the bag—features that help to give the beach bag a capability to quickly and easily transform from an expanded tote-bag-mode of configuration to a compact, substantially flat flotation-device-mode of configuration. One of these features calls for the interior chamber of the beach bag to be perimetrically surrounded by an upstanding sidewall of substantially uniform height that is defined by an endless chain of hingedly connected, substantially rectangular, relatively stiff flotation elements. The other of these features calls for the interior chamber to have no dividers or other structures that extend across the interior chamber of the bag in a way that could obstruct a rapid and orderly folding of the upstanding sidewall of the bag that permits an expanded beach bag to be quickly transformed into a compact, substantially flat, easily grasped flotation device.

The hinged connections that couple each adjacent pair of the flotation elements in the chain that perimetrically wraps the interior chamber extend along lines that parallel each other—and that thereby facilitate a quick and easy folding in an orderly manner as a beach bag that has been emptied of contents is collapsed to provide a compact, substantially flat flotation device that can be easily grasped by a person in peril of drowning.

To form the endless chain of hingedly connected flotation elements of the upstanding sidewall, a pair of relatively long, identically configured and exactly over-lapping sheets of thin, preferably slick-surfaced, water impervious, flexible material that are bonded one to the other along overlying top and bottom edge regions to define a relatively lengthy chamber located between the sheets. This lengthy chamber is subdivided by vertically extending lines of bonding that define the hinged lines of connection referred to just above.

The thin, flexible material that covers substantially all flotation elements of the beach bags described herein can be formed from a wide range of substances such as nylon, polyester, other plastics, thin cloth, textiles, canvas or other solid or woven substances, some of which may be so new as to not even have widely reached the marketplace as yet.

Each of the hingedly connected compartments of the chain is of generally rectangular configuration, and each snugly houses a single bat or panel of flotation material that also is of generally rectangular configuration. The flotation material that forms each bat or panel is of substantially uniform thickness, is relatively stiff, and preferably is defined by the same closed cell foam that is commonly used in wide variety of flotation devices, as is well known to those who are skilled in the art.

In preferred practice, the two elongate, over-lapping sheets of thin, flexible materials as described above what preferably have relatively slick surfaces that cause the upstanding sidewall to resist being punctured by thorns, thistles, branches and twigs as the beach bag is carried to a selected waterside location.

In some embodiments, the collapse of a beach bag to form a compact, substantially flat flotation device is achieved by causing selected opposed portions of the upstanding sidewall to translate toward and into engagement with each other, while at the same time, other portions of the upstanding sidewall pivot and fold in an orderly manner as they move away from the translating opposed sidewall portions and into engagement with each other—so that a compact and substantially flat flotation device is formed that includes of only two thicknesses of the flotation elements of the upstanding sidewall.

In other embodiments, the collapse of a beach bag to form a compact, substantially flat flotation device is achieved by causing selected opposed sidewall portions to translate toward each other while, at the same time, intermediate sidewall portions fold in an orderly manner into a space that is located between the translating opposed sidewall portions—so that a compact and substantially flat flotation device is formed that includes four thicknesses of the flotation elements of the upstanding sidewall.

Beach bags that embody the invention are also preferably provided with top walls or covers that are configured to overlie and close such upwardly facing openings as are defined by upper end regions of the upstanding sidewalls of the beach bags. In some embodiments, the top walls or covers are formed by a pair of substantially identical sheets that are continuously bonded along their peripheries to define a compartment or compartments that snugly enclose at least one relatively stiff flotation member between the two sheets. In some embodiments, the top walls or covers are hingedly connected to one or more of the flotation elements of the upstanding sidewall. In some embodiments, the top walls or covers have one or more openings formed therethrough that permit the upstanding handles to pass therethrough—so the presence of the handles extending through the openings in the top walls or covers helps the top walls or covers to stay in desired positions that close the top openings of the beach bags.

In substantially all embodiments of the invention, the beach bag is provided with an elongate tether that is normally held out of view by being carried inside a pocket formation attached to a selected surface of the upstanding sidewall of the bag. The elongate tether has one end region connected to the upstanding sidewall of the beach bag, with the remainder of the elongate tether normally being carried within the pocket formation that is preferably normally held closed by providing the pocket formation with a releasably closed flap. The pocket formation and its flap are preferably constructed using thin, flexible material that can be held releasably closed by hook and loop material attached to the flap and to a near-by portion of the upstanding sidewall or of the pocket formation. An opposite end region of the elongate tether preferably forms a loop through which one can insert one's arm to sling the loop over one's shoulder so the tether and the associated flotation device can be towed during swimming toward a person in peril of drowning who grips the delivered flotation device, or while swimming toward shore or other location of safety.

Beach bags that embody the invention preferably have thin, flexible bottom walls that are connected continuously along their entire peripheries to bottom portions of the chain of flotation elements that form the upstanding sidewall; and, each of the bottom walls is configured so it does not interfere with a quick and orderly folding of the flotation elements, as described above.

In some embodiments, the bottom wall is water pervious and/or is a mesh material (or another material that is provided with a plurality of discrete openings formed therethrough that permit water that enters or may have entered the interior of the bag (and that might inhibit the collapse of the bag or delay a swimmer) can escape.

If the beach bag has a pervious bottom wall, preferred practice calls for a sealed packet containing a commercially purchasable life vest or jacket to normally be carried within the interior of the beach bag at a location overlying the bottom wall in such a way as to normally close the openings of the bottom wall. When contents of the interior of the bag are jettisoned so the beach bag can be collapsed and rapidly folded to form a compact flotation device, the life vest or jacket is among contents that all are emptied from the bag's interior chamber. The presence and availability of a life vest or life jacket can safeguard the life of the rescuer who may chose to don the life vest or jacket if he or she is to enter the water to extend or otherwise deliver the compact, substantially flat flotation device to the person in peril of drowning, or while towing the person being rescued toward shore or other location of safety.

In other embodiments, a water pervious bottom wall having openings formed therethrough may be overlaid with a sheet of solid material that prohibits entry of sand or the like into a bottom region of the interior chamber when the beach bag is resting on its bottom wall on a sandy beach.

BRIEF DESCRIPTION OF THE DRAWINGS

These, and other features and advantages of the combination beach bag and flotation device of the present invention such as are disclosed herein will become apparent from the description and claims that follow, taken together with the accompanying drawings, wherein:

DETAILED DESCRIPTION

Figure 4:
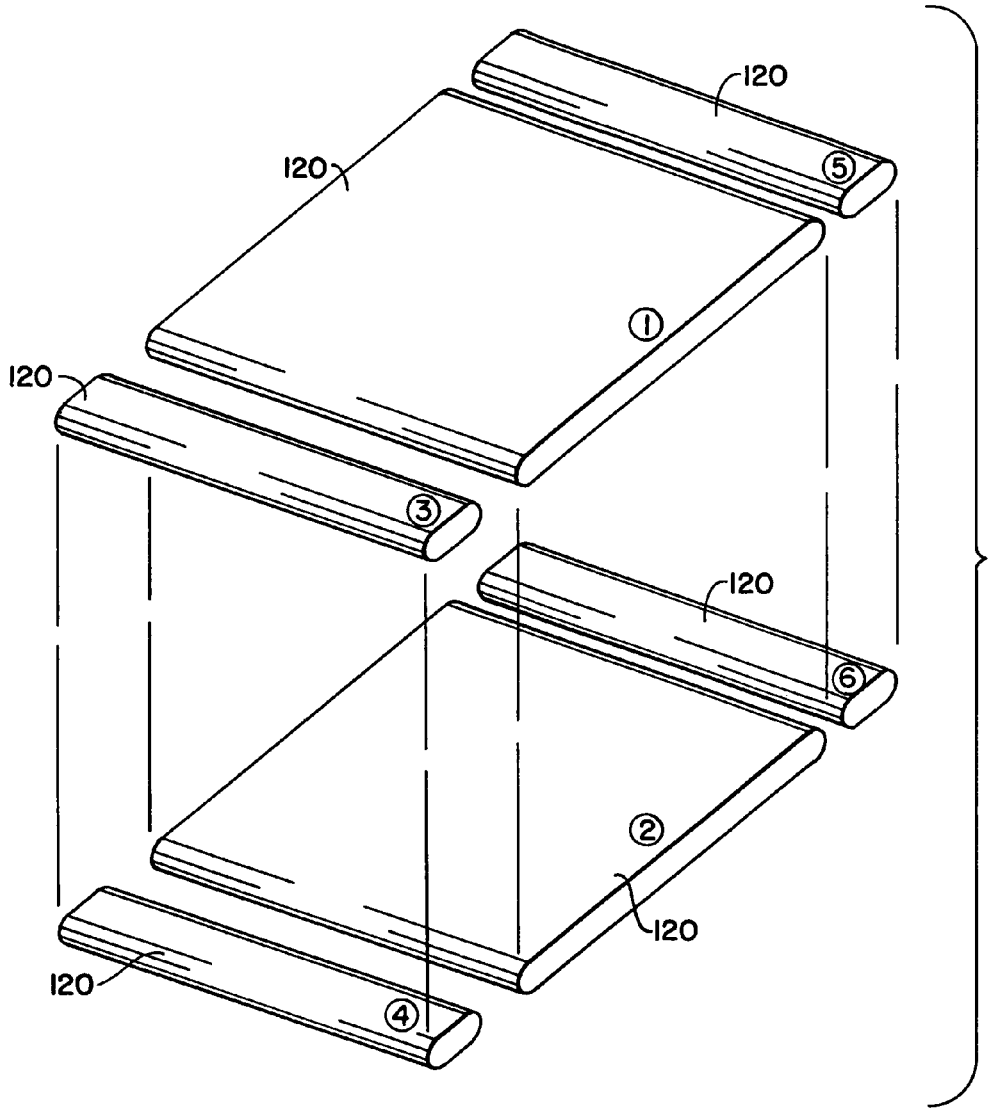
FIG. 4 is an exploded perspective view showing six relatively stiff flotation members that each is housed in a separate sealed compartment of the normally upstanding sidewall of the beach bag of FIGS. 1-3.
Figure 5:
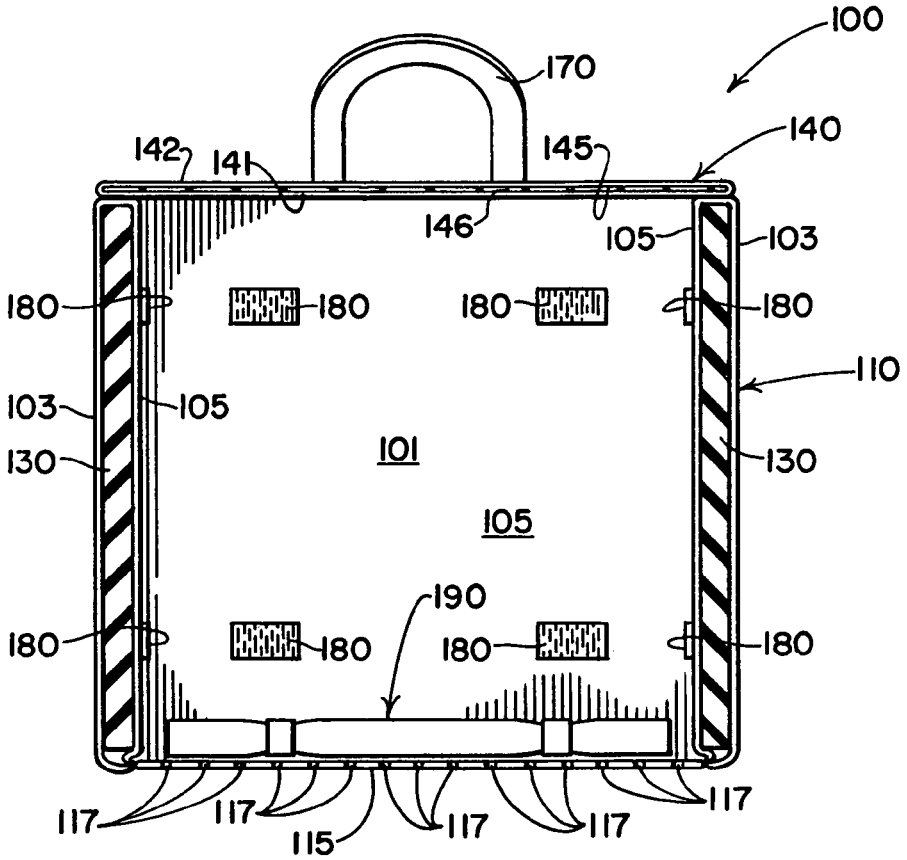
FIG. 5 is a cross-sectional view of the beach bag as seen from a plane indicated by a line 5-5 in FIG. 1, with the top or cover of the bag closed, with a thin bottom wall of the bag being seen to have a plurality of discrete openings formed therethrough, and with a sealed packet containing a commercially purchased life vest or jacket positioned to overlie the bottom wall to close the discrete openings formed through the bottom wall.
Figure 6:
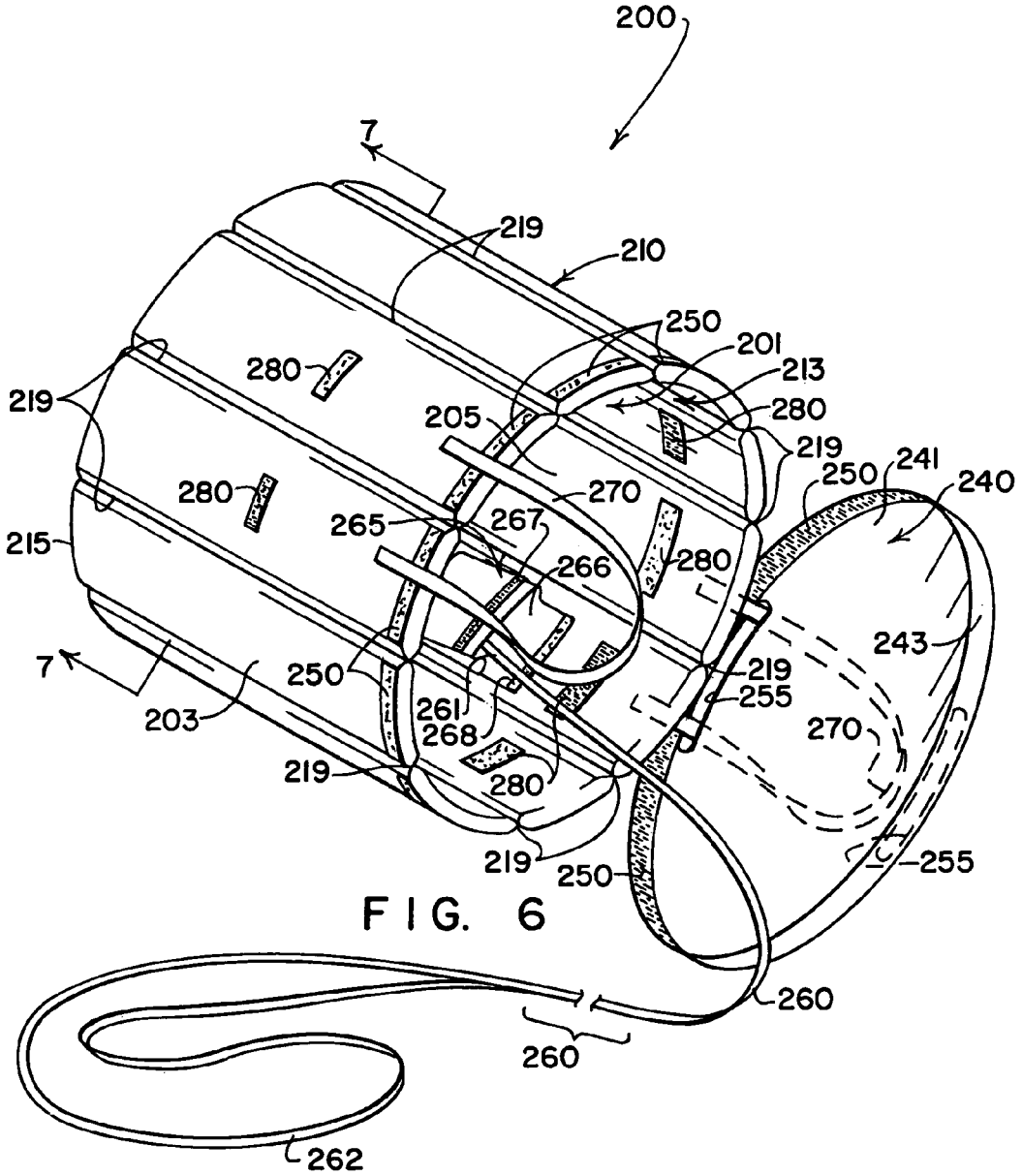
FIG. 6 a perspective view showing a second of two preferred forms of a beach bag embodying features of the present invention—with the beach bag in a normally expanded form, shown laying on one side portion of the bag's upstanding sidewall, with a pair of elongate, substantially identical, looped-strap type handles connected to opposed portions of the upstanding sidewall of the bag, with one of the handles underlying sidewall and cover portions of the bag and therefore being depicted by broken lines, with a top or cover of the bag having elongate slots formed therethrough for the handles to extend therethrough, and with hook and loop material being provided on the interior of a depending lip of the top or cover, and on portions of the upstanding sidewall of the bag.
Figure 7:
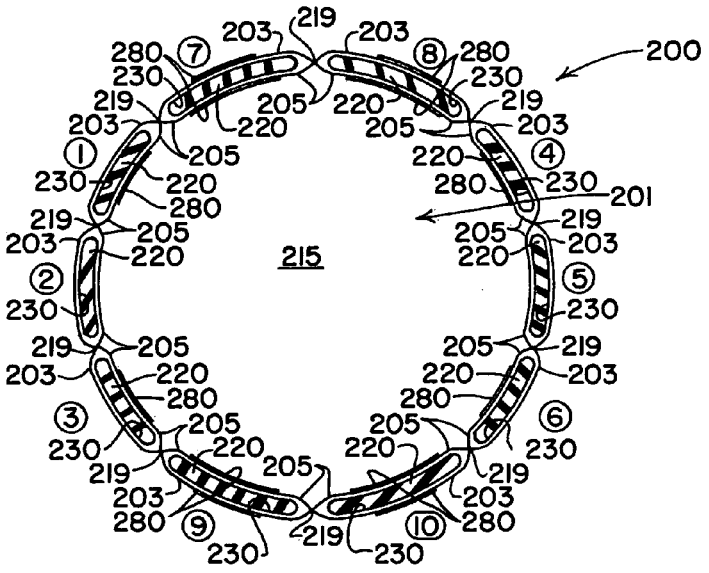
FIG. 7 is a cross-sectional view of the beach bag of FIG. 6, as seen from a plane indicated by a line 7-7 in FIG. 6; and, FIG. 8 is a perspective view of the beach bag of FIG. 6 in a collapsed, substantially flat form that provides a compact, easy-to-grip flotation device, with a pocket formation provided on an interior surface of the upstanding sidewall shown open, and with an elongate tether fed or payed out from the pocket in which the elongate tether normally is housed, with the tether shown foreshortened and having a relatively lengthy loop formed in one end region of the tether which has its opposite end region securely connected to the upstanding sidewall.
Figure 8:
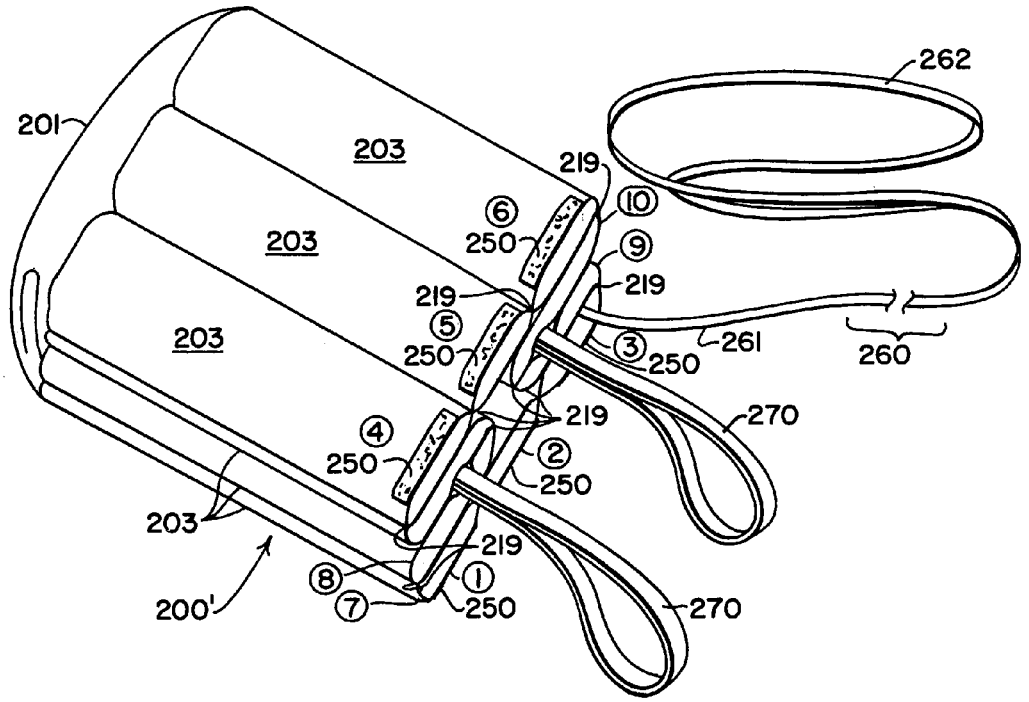

In the paragraphs that follow, two similarly constructed and similarly performing collapsible and expandable beach bags 100 and 200 are described. FIGS. 1-5 show features of the beach bag 100. FIGS. 6-8 show features of the beach bag 200.

As will quickly become apparent from a perusal of the paragraphs that follow, corresponding numerals are used to refer to similar components and features of the beach bags 100, 200. The numerals used with components and features of the beach bag 200 differ by a magnitude of one hundred from the numerals used with corresponding components and features of the beach bag 100.

Figure 1:
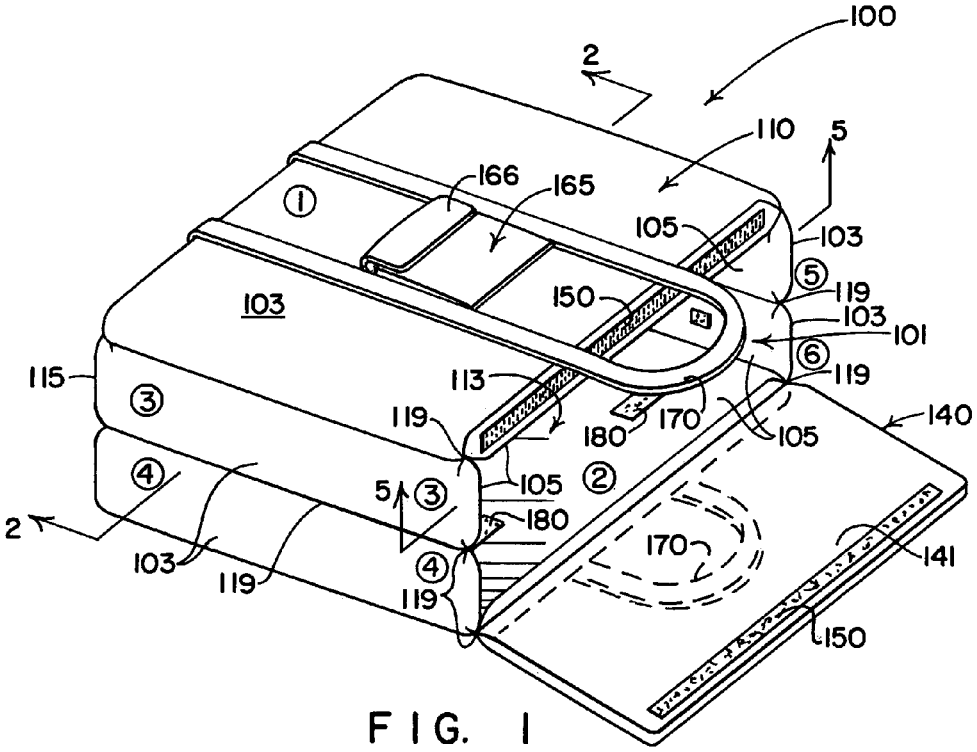
FIG. 1 is a perspective view showing one of two preferred forms of a beach bag embodying features of the present invention—with the beach bag in a normally expanded form, shown laying on one side portion of the bag's normally upstanding sidewall, with a pair of elongate looped-strap type handles connected to opposed portions of the upstanding sidewall of the bag, with one of the handles underlying a hinged and opened top or cover of the bag and being depicted by broken lines, with both of the handles being defined by a single elongate strap that not only has upwardly extending loops that define the two handles, but also reinforces opposite portions of the upstanding sidewall and the bottom wall of the bag, with a releasably closed pocket formation being provided on an exterior surface of the upstanding sidewall of the bag, and with the beach bag having a top or cover hingedly connected to an upper portion of the upstanding sidewall of the bag, and with hook and loop material being provided on the top or cover and on an upper surface of a portion of the upstanding sidewall opposite from where the the top or cover is pivotally connected to the bag's upstanding sidewall.
Figure 2:
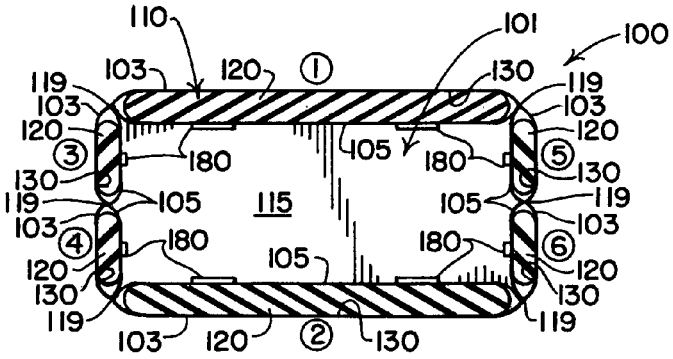
FIG. 2 is a cross-sectional view of the bag on a reduced scale as seen from a plane indicated by a line 2-2 in FIG. 1, and showing eight example locations where hook and loop material can be provided on interior surface portions of the upstanding sidewall of the bag.
Figure 3:
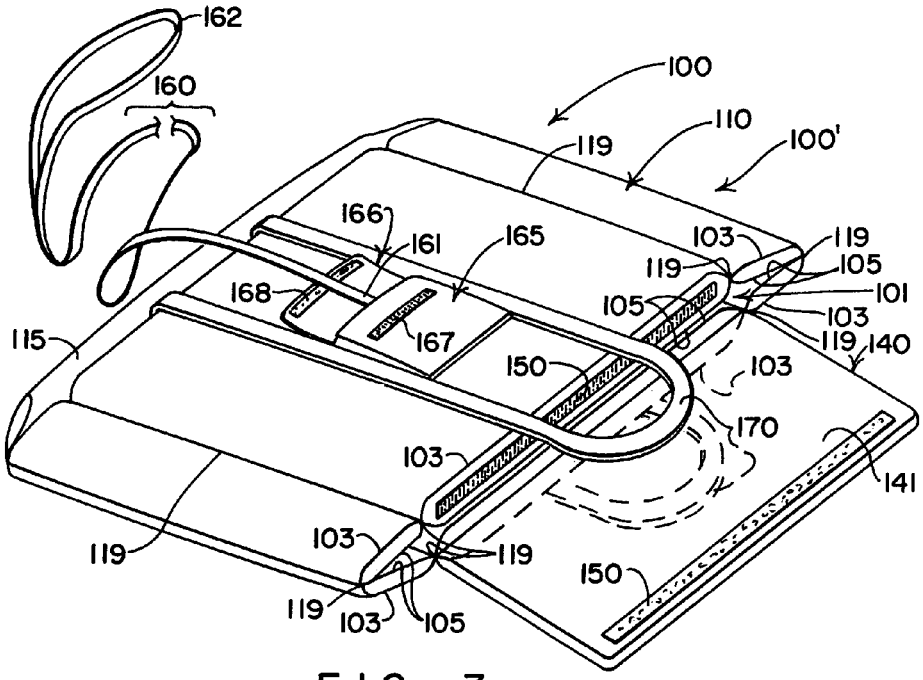
FIG. 3 is a perspective view of the beach bag of FIG. 1 in a collapsed, substantially flat form that provides a compact, easy-to-grip flotation device, with the pocket open, and with an elongate tether fed or payed out from the pocket in which the elongate tether normally is housed, with the tether being foreshortened, with a loop being provided in an end region of the tether, and with one of the handles that underlies the pivoted-open cover of the bag again being depicted by broken lines.

Referring to FIG. 1, the beach bag 100 is shown in an expanded form with an interior chamber 101 that can be used to carry items useful during an excursion to a beach or other waterside location. In FIG. 3, a collapsed form 100' of the beach bag 100 is shown that has all contents removed from the interior chamber 101 so the beach bag 100 can be folded to form the depicted compact, substantially flat, easily grasped flotation device 100'.

Referring to FIG. 6, the beach bag 200 is shown in an expanded form with an interior chamber 201 that can be used to carry items during an excursion to a beach or other waterside location. In FIG. 8, a collapsed form 200' of the beach bag 200 is shown that has all contents removed from the interior chamber 201 so the beach bag 200 can be folded to provide the depicted compact, substantially flat, easy to grasp flotation device 200'.

Returning to FIG. 1, the beach bag 100 has a continuous normally upstanding sidewall 110 that perimetrically surrounds the interior chamber 101 of the beach bag 100. The upstanding sidewall 110 is defined by two identical, exactly overlying sheets 103, 105 of thin, slick, water impervious and tear-resistant plastic material that is quite flexible. The sheet 103 defines the exterior of the upstanding sidewall 110 of the beach bag 100. The sheet 105 defines the interior of the upstanding sidewall 110 that faces inwardly toward the interior chamber 101. Upper end portions of the upstanding sidewall 110 defines an upwardly opening 113 of the beach bag 100 that provides access to the interior chamber 101 of the beach bag 100.

Referring to FIG. 6, the beach bag 200 has a continuous normally upstanding sidewall 210 that perimetrically surrounds the interior chamber 201 of the beach bag 200. The upstanding sidewall 200 is defined by two identical, exactly overlying sheets 203, 205 of thin, slick, water-impervious and tear-resistant material that is quite flexible. The sheet 203 defines the exterior of the upstanding sidewall 210 of the beach bag 100. The sheet 205 defines the interior of the upstanding sidewall 210 that faces inwardly toward the interior chamber 201. Upper end portions of the upstanding sidewall 210 defines an upwardly opening 213 of the beach bag 200 that provides access to the interior chamber 201 of the beach bag 200.

Referring to FIGS. 1-3 and 5, upper and lower overlying portions of the exterior and interior sheets 103, 105 that form the upstanding sidewall 110 are bonded, sewn and/or otherwise securely continuously fixed, joined or sealed together. At separate locations (designated by the numerals 119) along the lengths of the overlying sheets 103, 105, the overlying sheets 103, 105 are bonded, sewn and/or otherwise securely and continuously fixed, joined or sealed together, by which arrangement the upstanding sidewall 110 is divided into a chain of individual sealed compartments 120, best shown in FIG. 2. The hinged bonded lines 119 along which adjacent ones of the sealed compartments 120 are joined and pivotally coupled extend parallel to each other—and extend substantially vertically when the beach bag 100 rests on its flexible bottom wall 115 which is labeled in FIGS. 2, 3 and 5.

Referring to FIG. 6, upper and lower overlying portions of the exterior and interior sheets 203, 205 that form the upstanding sidewall 210 are bonded, sewn and/or otherwise securely continuously fixed, joined or sealed together. At separated locations (designated by the numerals 219) along the lengths of the overlying sheets 203, 205, the overlying sheets 203, 205 are bonded, sewn and/or otherwise securely continuously fixed, joined or sealed together, by which arrangement the upstanding sidewall 210 is divided into a chain of individual sealed compartments 220, best shown in FIG. 7. The lines 219 along which adjacent ones of the sealed compartments 220 are joined extend parallel to each other—and extend substantially vertically when the beach bag 200 rests on its flexible bottom wall 215 that is labeled in FIGS. 6-8.

Before leaving the subject of the flexible bottom walls 115, 215, it should be explained that each of the bottom walls 115, 215 is formed from a sheet of the same thin, slick-surfaced, and tear resistant material (such as has been described above) that forms the overlying sheets 103, 105 and 203, 205 of the upstanding sidewalls 110, 210, respectively. Furthermore, the perimeters of each of the bottom walls 115, 215 is continuously fixed, joined or sealed to all bottom portions of each of the upstanding sidewalls 110, 210, respectively. As can be seen in FIG. 5, the beach bag 100 can have its bottom wall 115 provided with discrete openings formed therethrough to permit water that enters, or that may have entered, the interior chamber 101 to escape so the bag 100 will not act to inhibit forward movement of a swimmer—or so that water in the interior chamber 101 will not inhibit a proper orderly collapse of the beach bag. The beach bag 200, shown in FIGS. 6-8 is shown having a water impervious bottom wall 215; however, either or both of the bottom walls 115, 215 can be formed from mesh material, to let water pass readily therethrough.

Housed within each of the individually sealed compartments 120 of the upstanding sidewall 110 of the beach bag 100 are generally rectangular, relatively stiff bats or panels 120 of closed foam flotation material such as is commonly used to form all manner of flotation devices that are well known to those who are skilled in the art. FIG. 4 shows the six bats or panels 120 used in the upstanding sidewall 110 which are also designated by circled numerals 1 thru 6. As can be seen, the bats or panels 120 designated by the numerals 1 and 2 are of substantially equal but of longer length than are the bats or panels designated by the numerals 3 thru 6, which are of substantially equal but of shorter length.

Housed within each of the individually sealed compartments 220 of the upstanding sidewall 210 of the beach bag 200 are ten relatively stiff bats or panels 220 of closed foam flotation material such as is commonly used to form all manner of flotation devices that are well known to those who are skilled in the art. FIG. 7 has the various flotation bats or panels 220 designated by circled numerals 1 thru 10. As can be seen, the bats or panels 220 designated by the numerals 7 thru 10 are of substantially equal but of longer length than are the bats or panels 220 designated by the numerals 1 thru 6 which are of substantially equal of but shorter length.

The beach bag 100 is provided with a top wall or cover 140 that is preferably defined by two overlying sheets 141, 142 of the same thin, slick, water-impervious and tear-resistant material as forms the overlying sheets 103, 105 and 203, 205 that define the exterior and interior covers of the upstanding sidewalls 110, 210, respectively. The overlying sheets 141, 142 are of generally rectangular shape, and are bonded, sewn and/or otherwise securely continuously fixed, joined or sealed together along overlying edge regions that define the perimeter of the top wall or cover 140—so a sealed compartment 145 (shown in FIG. 5) is formed that contains a thin relatively rigid bat or panel 146 of the same flotation material as forms the bats or panels 130, 230 of the upstanding side walls 110, 210 of the beach bags 100, 200, respectively. The top wall or cover 140 is configured to close the open upper end region (i.e., the top opening 113) of the beach bag 100. Hook and loop fastening material 150 is provided on the top wall or cover, and on an upper part of the upstanding sidewall 110 to releasably hold the top wall or cover in a position overlying the interior chamber 101 (i.e., closing the top opening 113 of the beach bag 100).

The beach bag 200 is provided with a top wall or cover 240 that is preferably defined by a single flexible sheet 241 of the same thin, slick, water-impervious and tear-resistant material as forms the overlying sheets 103, 105 and 203, 205 that define the exterior and interior covers of the upstanding sidewalls 110, 210, respectively. The sheet 241 is of generally circular configuration, and has a depending lip 243 that is provided with hook and loop fastening material 250 that can releasably connect with other hook and loop fastening material 250 that is provided on an upper part of the upstanding sidewall 210 of the beach bag 200 to cooperate with the hook and loop fastening material 250 on the top wall or cover 240 to hold closed the open upper end region (i.e., the top opening 213) of the beach bag 200.

Whereas the top wall or cover 140 is hingedly connected to an upper portion of the upstanding sidewall 110, the top wall or cover 240 is provided with a pair of elongate holes or slots 255 through which the upstanding handles 270 can extend to assist in retaining the top wall or cover 240 in a closed position.

Referring to FIG. 3, the beach bag 100 or flotation device 100' has an elongate tether 160 with one end region 161 affixed to an exterior surface of the upstanding side wall 110, and with an opposite end region 162 provided with a loop that is long enough to be slung over a shoulder of a rescuer (not shown) who may pull or tug on the tether 160 to tow the flotation device 100' toward shore or other location of safety after a person in peril of drowning (not shown) has grasped the flotation device 100' formed by the collapsed beach bag 100 as shown in FIG. 3.

Referring to FIG. 8, the beach bag 200 or flotation device 200' has an elongate tether 260 with one end region 261 affixed to an interior surface of the upstanding side wall 210, and with an opposite end region 262 provided with a loop that is long enough to be slung over a shoulder of a rescuer (not shown) who may pull or tug on the tether 260 to tow the flotation device 200' toward shore or other location of safety after a person in peril of drowning (not shown) has grasped the flotation device 200' formed by the collapsed beach bag 200 as shown in FIG. 3.

The elongate tethers 160, 260 are depicted as being of indefinite length in FIGS. 3 and 6, respectively because one can provide the elongate tethers in substantially any desired length. Tether lengths of at least about 10 feet are recommended so a rescuer (not shown) can space himself or herself from a person in peril of drowning (not shown) who may be thrashing around while gripping one of the flotation devices 100' or 200'. It is safer to maintain a distance between the rescuer and a person being rescued. Tether lengths of greater than 10 feet will be selected by some, as a matter of choice.

Normally (i.e., when the beach bag 100 is in its expanded form shown in FIGS. 1 and 3), the elongate tether 160 is contained in a pocket formation 165 that has a closure flap 166. When collapsed and folded to form the flotation device 100' shown in FIG. 3, the closure flap 166 of the pocket 165 is opened and portions of the elongate tether 160 are fed or payed out as shown in FIG. 3. The closure flap 166 and the pocket formation 165 carry hook and loop material 167, 168, respectively, to hold the closure flap normally closed.

Normally (i.e., when the beach bag 200 is in its expanded form shown in FIG. 6), the elongate tether 260 is contained in a pocket formation 265 that has a closure flap 266 as shown in FIG. 6. When collapsed and folded to form the flotation device 200' shown in FIG. 8, the closure flap 266 of the pocket 265 is opened (in the same manner as shown in connection with the pocket 165, pocket flap 166 and tether 160 in FIG. 3) of the elongate tether 260 are fed or payed out as shown in FIG. 3. The closure flap 266 and the pocket formation 265 carry hook and loop material 267, 268, respectively, to hold the closure flap 266 normally closed.

To help retain the collapsed, folded, compact and substantially flat configurations of the flotation devices 100' and 200' shown in FIGS. 3 and 8, respectively, patches of hook and loop material designated by the numerals 180, 280 may be placed at appropriate locations on interior and exterior surface portions of the beach bags 100, 200, respectively, so that, when portions of the upstanding side walls 110, 210 fold into engagement with each other, the hook and loop patches 180, 280 releasably engage and help to retain engaged portions of the upstanding sidewalls 110, 210 together in the compact and substantially flat configurations shown in FIGS. 3 and 8, respectively.

In accordance with method features of the present invention, a beach bag (such as the beach bags 100, 200) having an upstanding sidewall (such as the upstanding sidewalls 110, 210) formed from hingedly connected upstanding generally rectangularly shaped flotation members (such as are described above) is provided with a flexible bottom wall (such as the bottom walls 115, 215), and with a flexible top or cover (such as the covers 140, 240), with upstanding handles (such as the handles 170, 270) on opposed upper portions of the upstanding sidewalls 110, 210. When a flotation device (such as the flotation devices 100', 200') is needed for use in a water rescue, contents of the interior of the beach bag are jettisoned, and opposed portions of one of the upstanding sidewalls 110, 210 are folded (as has been described above) to form a compact, substantially flat flotation device (100' or 200') that is thrown, handed or otherwise delivered to a person in peril of drowning who then forcefully grips the flotation device 100' or 200' while a rescuer pulls on an elongate tether 160, 260 connected to the upstanding sidewall 110, 210 of the flotation device 100', 200' to tow the person in peril of drowning toward shore or another location of safety.

Referring to FIG. 5, a sealed packet 190 containing a commercially purchased life vest or jacket (not shown) is preferably positioned in the beach bag 100 to overlie and to thereby close the discrete openings 117 that extend through the bottom wall 115 when the beach bag is being used as a tote to contain such items as may be useful during an excursion to a beach or other waterside location. When the beach bag 100 is emptied of contents (as has been described), the removal from the interior chamber 101 of the packet 190 containing a life vest or jacket no longer closes the openings 117, so water can pass through the bottom wall 115.

A preferred type of commercially available life vest or jacket is a U.S. Coast Guard approved Stearns Adult Type II life jacket that has a woven polyester shell for minimal chafing, well suited to be worn by adults that weigh in excess of 90 pounds. Another Stearns life vest that can be provided in the packet 190 is an Adult Classic Series that has three chest belts that help make a day on the water a comfortable and safe one.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended that the claims that follow address such patentable features as are disclosed herein.

What is claimed is:

1. A lifesaving beach bag transformable from a normally expanded configuration of the beach bag at a time after a substantially unobstructed interior chamber of the beach bag has been emptied of contents, to form a compact, substantially flat flotation device that can easily be grasped by a person in peril of drowning, with the beach bag when in the normally expanded configuration having an upstanding sidewall of substantially uniform height defined by an endless chain of substantially rectangular, vertically extending, stiff, flotation elements that perimetrically surrounds the substantially unobstructed interior chamber, and with adjacent ones of the flotation elements being pivotally coupled by hinged connections that permit selected ones of the flat flotation elements to move into a closely overly relationship one with another that substantially closes the interior chamber as the overlying flotation panels cooperate to form the compact, substantially flat flotation device.

2. The lifesaving beach bag of claim 1 with the interior chamber having a capacity within the range of one cubic foot to no larger than one and a half cubic feet.

3. The lifesaving beach bag of claim 1 including an elongate tether having one end region of the tether securely connected to a selected portion of the upstanding sidewall.

4. The lifesaving beach bag of claim 3 with the selected portion of the upstanding side wall defining a pocket formation that normally contains the elongate tether, but can be opened to permit a portion of the tether to be fed or payed out.

5. The lifesaving beach bag of claim 1 with a bottom wall of tear-resistant fabric having a periphery connected contiguously to bottom regions of the flotation elements of the upstanding sidewall.

6. The lifesaving beach bag of claim 1 with a top or cover being provided to close an upwardly facing opening defined by upper portions of the upstanding sidewall.

7. The lifesaving beach bag of claim 6 with a pair of upstanding handles connected to the upper portions of the upstanding sidewall.

8. The lifesaving beach bag of claim 7 with at least one opening formed through the top or cover that permits a handle to extend therethrough.

9. A lifesaving beach bag having an upstanding sidewall defined by an endless chain of stiff, upstanding flotation elements that normally wraps perimetrically around a substantially unobstructed interior chamber of the beach bag that, when the beach bag is in a normally expanded attitude, has a capacity within the range of a cubic foot to one and a half cubic feet, into which interior chamber items a useful during an excursion to a beach or other waterside location can be inserted through an upwardly facing opening of the expanded beach bag defined by upper regions of the upstanding flotation elements, with adjacent ones of the upstanding flotation elements being hingedly connected along substantially vertically extending lines where a pair of substantially identical overlying sheets of flexible, tear-resistant material are bonded to connect and segregate adjacent ones of a plurality of sealed compartments that each contains a different stiff, generally rectangular bat or panel of flotation material, with the beach bag additionally including a bottom wall configured to underlie the interior chamber when the beach bag is normally expanded, and to not hinder a folding of the upstanding sidewall along selected ones of the vertically extending lines once the interior of the beach bag has been emptied of contents, with the folding serving to move toward each other opposed portions of the normally upstanding sidewall to transform the beach bag to a compact flotation device that is substantially flat and can easily be forcefully grasped by a person in peril of drowning.

10. The lifesaving beach bag of claim 9 having an elongate tether with one end region of the tether fixed to the upstanding sidewall.

11. A lifesaving beach bag that, in an expanded form, has an upstanding sidewall defined by an endless chain of upstanding flotation elements, with the chain of flotation elements perimetrically wrapping an interior chamber having a capacity not greater than about one and a half cubic feet, with adjacent ones of the flotation elements in the chain having adjacent, vertically extending edge regions that are pivotally connected to thereby permit the adjacent flotation elements to move relative to each other about substantially vertically extending hinge lines so that selected ones of the flotation elements can move into overlying relationships thereby cooperating to close the interior chamber and to form a compact, substantially flat flotation device that can be grasped by a person in peril of drowning to help keep the person afloat, thereby assisting with a water rescue of the person in peril.

12. The lifesaving beach bag of claim 11 additionally including a bottom wall formed from tear-resistant material having a perimeter contiguously connected to bottom regions of the flotation elements one after the other so the bottom wall underlies the interior chamber when the beach bag is expanded.

13. The lifesaving beach bag of claim 12 with the material that defines the bottom wall being water pervious.

14. The lifesaving beach bag of claim 13 with the material forming the bottom wall having discrete openings formed therethrough.

15. The lifesaving beach bag of claim 11 additionally including a pair of handles connected at spaced locations to the upstanding sidewall and extending upwardly from the upstanding sidewall to facilitate carrying of the beach bag to transport contents that have been inserted into the interior chamber of the beach bag.

16. The lifesaving beach bag of claim 11 additionally including an elongate tether having one end region fixed to the upstanding sidewall.

17. The lifesaving beach bag of claim 16 additionally including a releasably closed pocket formation provided on the upstanding side wall near where the tether is fixed to the upstanding side wall, with the tether normally being carried inside the pocket formation and being extensible from within the pocket formation so the tether can be pulled by a rescuer toward a location of safety.

18. The lifesaving beach bag of claim 17 with the pocket formation having an opening through which the tether can extend, with a closure flap for assisting the pocket formation to normally retain a portion of the tether in the pocket.

19. The lifesaving beach bag of claim 11 with the upstanding sidewall having individual chambers that each contain a different one of the flotation elements.

20. The lifesaving beach bag of claim 11 additionally including a tear-resistant top or cover movably connected to a selected upper portion of the upstanding sidewall and configured to close an opening defined by the upstanding side wall.

21. The lifesaving beach bag of claim 11 with at least one handle connected to an exterior portion of the upstanding sidewall of the bag to facilitate the bag being carried.

22. A collapsible-expansible lifesaving beach bag that, when in a normally expanded attitude, forms an upwardly-opening portable container having an interior chamber suitable to receive, contain and transport items useful during an excursion to a location alongside a body of water, and, when in a collapsed attitude with the interior chamber emptied of contents, forms a compact, substantially flat flotation rescue device deliverable to and easily grasped by a person in peril of drowning, the beach bag comprising an upstanding sidewall that perimetrically surrounds the interior chamber which has a chamber of between one to one and a half cubic feet in size, with the upstanding sidewall being formed from an endless chain of stiff, generally rectangular, substantially flat flotation elements with adjacent ones of the flotation elements being hingedly connected along vertically extending hinge lines that enable the upstanding side wall to fold to form the compact, substantially flat flotation device, with the beach bag additionally having a flexible bottom wall that is perimetricaly connected continuously and sequentially to bottom portions of all of the flotation elements, and having a flexible top wall that can be moved between an open position providing access through a top opening of the beach bag to the interior chamber, and a closed position overlying the inner chamber and closing the top opening.

23. The beach bag of claim 22 additionally having at least one upstanding handle connected to an upper part of the upstanding sidewall.

24. The beach bag of claim 22 additionally including an elongate tether having one end region fixed to the upstanding sidewall, with the tether being extensible from the upstanding sidewall to provide a towable formation that can be pulled toward a location of safety when the beach bag is folded to form the compact, substantially flat flotation device.

25. A lifesaving beach bag defined by an interconnected set of bottom and side walls positionable in an expanded configuration of the beach bag to contiguously surround and underlie an interior, upwardly opening chamber having a volume of at least one cubic foot suited to contain and transport contents useful at a waterside location, and positionable in a collapsed configuration of the beach bag when emptied of said contents to form a compact flotation device, with said side walls including a plurality of substantially flat, stiff wall segments of flotation material that are covered by, and are flexibly and contiguously interconnected by, tear-resistant material that enable the substantially flat, stiff wall segments to extend in closely overlying relationship forming said compact flotation device when the beach bag is in the collapsed configuration, with said bottom wall defined by a sheet of flexible material that is perimetrically connected to bottom portions of the side wall, and with the flotation device having an elongate tether connected thereto.

* * * * *